US009482978B2

(12) United States Patent
Horiba et al.

(10) Patent No.: US 9,482,978 B2
(45) Date of Patent: Nov. 1, 2016

(54) LIQUID DEVELOPER, DEVELOPER CARTRIDGE, AND IMAGE FORMING APPARATUS

(71) Applicant: FUJI XEROX CO., LTD., Tokyo (JP)

(72) Inventors: Koji Horiba, Kanagawa (JP); Masahiro Oki, Kanagawa (JP); Yoshihiro Inaba, Kanagawa (JP); Akira Imai, Kanagawa (JP); Daisuke Yoshino, Kanagawa (JP); Takako Kobayashi, Kanagawa (JP); Hiroyuki Moriya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/815,029

(22) Filed: Jul. 31, 2015

(65) Prior Publication Data

US 2016/0223929 A1 Aug. 4, 2016

(30) Foreign Application Priority Data

Feb. 2, 2015 (JP) ..... 2015-018464

(51) Int. Cl.
*G03G 9/135* (2006.01)
*G03G 9/13* (2006.01)

(52) U.S. Cl.
CPC ..... *G03G 9/131* (2013.01)

(58) Field of Classification Search
CPC ..... G03G 9/1355
See application file for complete search history.

(56) References Cited

FOREIGN PATENT DOCUMENTS

| | | | |
|---|---|---|---|
| JP | 2011-039308 | A | 2/2011 |
| JP | 2014-038220 | A | 2/2014 |
| JP | 2014-038234 | A | 2/2014 |

*Primary Examiner* — Hoa V Le
(74) *Attorney, Agent, or Firm* — Oliff PLC

(57) ABSTRACT

A liquid developer includes a carrier liquid, and a toner particle which contains a resin having an unsaturated double bond, a compound represented by the formula (I) and a photopolymerization initiator and whose surface is treated by a polyamine, (I)

wherein m and n each independently represent an integer of 1 to 10,000; m+n represents an integer of 10 to 10,000; and $R^1$, $R^2$, and $R^3$ each independently represent a single bond or a divalent aliphatic hydrocarbon group having 1 to 12 carbon atoms.

16 Claims, 1 Drawing Sheet

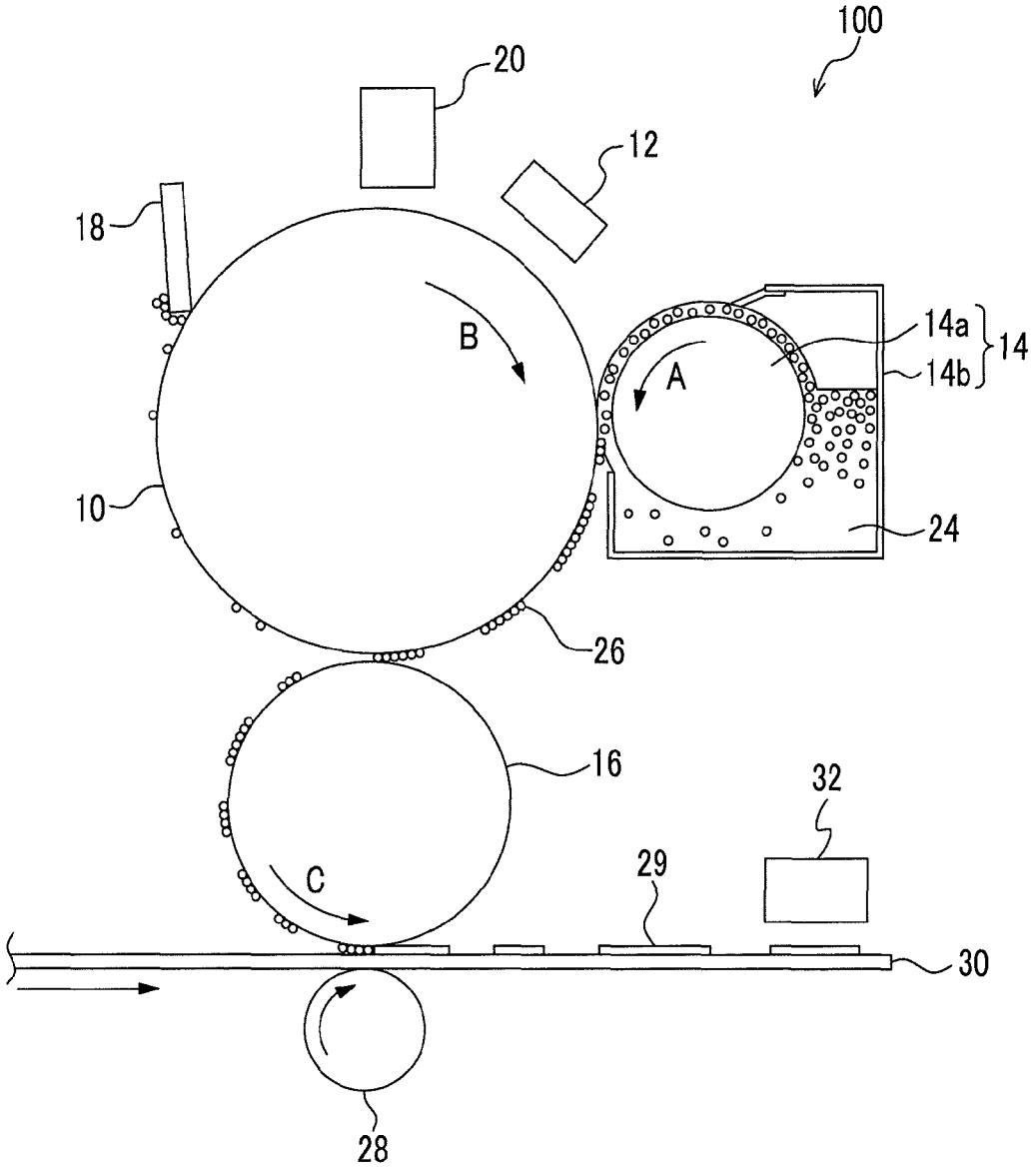
100
20
12
18
B
A
14a
14
14b
10
24
26
16
32
C
29
30
28

LIQUID DEVELOPER, DEVELOPER CARTRIDGE, AND IMAGE FORMING APPARATUS

CROSS-REFERENCE TO RELATED APPLICATIONS

This application is based on and claims priority under 35 USC 119 from Japanese Patent Application No. 2015-018464 filed Feb. 2, 2015.

BACKGROUND

1. Technical Field

The present invention relates to a liquid developer, a developer cartridge, and an image forming apparatus.

2. Related Art

A method of visualizing image information though an electrostatic charge image such as an electrophotography method is currently used in many fields. In the electrophotography method, a latent image (electrostatic latent image) is formed on an image holding member in charging and exposing processes (latent image forming process), and the latent image is visualized by developing an electrostatic latent image with a developer for developing an electrostatic charge image (hereinafter, also simply referred to as a "developer") including a toner for developing an electrostatic charge image (hereinafter, also simply referred to as a "toner") (developing process), and performing a transfer process and a fixing process. As a developer used in a dry development method, a two-component developer containing a toner and a carrier, and a single component developer in which a magnetic toner or a non-magnetic toner is singly used are exemplified.

A liquid developer used in a wet development method is obtained by dispersing toner particles in an insulating carrier liquid. A liquid developer in which toner particles containing a thermoplastic resin are dispersed in a volatile carrier liquid, a liquid developer in which toner particles containing a thermoplastic resin in a hardly volatile carrier liquid are dispersed, and the like, are known.

SUMMARY

According to an aspect of the invention, there is provided a liquid developer including:

a carrier liquid; and a toner particle which contains a resin having an unsaturated double bond, a compound represented by the formula (I) and a photopolymerization initiator, and whose surface is treated by a polyamine, (I)

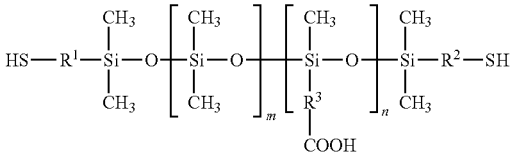

wherein m and n each independently represent an integer of 1 to 10,000; m+n represents an integer of 10 to 10,000; and $R^1$, $R^2$, and $R^3$ each independently represent a single bond or a divalent aliphatic hydrocarbon group having 1 to 12 carbon atoms.

BRIEF DESCRIPTION OF THE DRAWINGS

Exemplary embodiments of the present invention will be described in detail based on the following figure, wherein:

FIG. 1 is a configuration view schematically illustrating an example of an image forming apparatus according to an exemplary embodiment of the invention.

DETAILED DESCRIPTION

Exemplary embodiments of the invention are described below. The exemplary embodiments are provided as examples implementing the invention, and the invention is not limited thereto.

Since a toner using a polyester resin as a binder resin generally does not have heat resistance sufficiently, image deterioration referred to as so-called document offset, in which a part of a toner image is peeled off when toner images or a toner image and paper overlap each other and stand, still occurs in some cases. Further, an image formed using a toner that contains a polyester resin as a binder resin has weak bending properties and solvent resistance in some cases. For this reason, the present inventors suggest that heat resistance, bending properties, and solvent resistance are improved through photocuring made by performing a thiol-ene reaction using a toner including a resin containing an unsaturated double bond, a thiol compound containing a bi- or higher functional thiol group such as a pentaerythritol tetrafunctional thiol compound, and a polymerization initiator. However, since a sulfanyl group (thiol group) of this thiol compound is not fixed to the toner, in the case where the toner preserved or recycled for use is used as a liquid developer, the thiol compound is eluted into a carrier liquid and the photocuring function is deteriorated in some cases.

The present inventors find that deterioration of photocuring properties is prevented by using a liquid developer that contains a carrier liquid, and a toner particle containing a resin including an unsaturated double bond, a compound represented by the above formula (I), a photopolymerization initiator, and whose surface is treated by a polyamine. The reason therefor is considered that in the case where a dimethyl silicone compound which contain a carboxyl group at the side chain and both terminals being sulfanyl modified, which is represented by the formula (I), is used in place of a thiol compound such as a pentaerythritol thiol compound, the carboxyl group of the dimethyl silicone compound is adsorbed by a polyamine on the surface of toner particles so that the carboxyl group is fixed to the toner particles and elution thereof into the carrier liquid is prevented, and thus deterioration of photocuring properties is prevented. In addition, positive charging properties are improved, a photocuring reaction is promoted, and viscosity of the liquid developer is decreased.

Liquid Developer

The liquid developer according to the exemplary embodiment of the invention contains a carrier liquid; and a toner particle which contains a resin having an unsaturated double bond, a compound represented by the formula (I), and a photopolymerization initiator and whose surface is treated by a polyamine. A liquid developer having more excellent positive charging characteristics is obtained when toner particles whose surface is treated by a polyamine are used as toner particles and the compound represented by the formula (I) is contained.

(I)

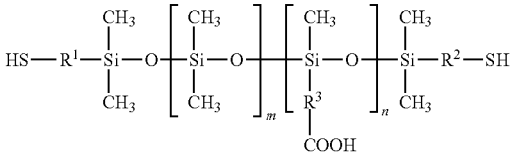

(In the formula (I), m and n each independently represent an integer of 1 to 10,000; m+n represents an integer of 10 to 10,000; and $R^1$, $R^2$ and $R^3$ each independently represent a single bond or a divalent aliphatic hydrocarbon group having 1 to 12 carbon atoms.)

In the compound represented by the formula (I), $R^1$, $R^2$ and $R^3$ each independently represent a single bond or a divalent aliphatic hydrocarbon group having 1 to 12 carbon atoms and each preferably represent a single bond or a divalent aliphatic hydrocarbon group having 2 to 12 carbon atoms. Examples of the divalent aliphatic hydrocarbon group having 1 to 12 carbon atoms include a methylene group, an ethylene group, a trimethylene group, a tetramethylene group, a hexamethylene group, an octamethylene group, a decamethylene group, an undecamethylene group, and a dodecamethylene group. A dodecamethylene group is preferable for $R^1$ and $R^2$ and an ethylene group or a trimethylene group is preferable for $R^3$.

In the formula (I), m represents an integer of 1 to 10,000, preferably an integer of 10 to 10,000. n represents an integer of 1 to 10,000, preferably an integer of 10 to 10,000. m+n represents an integer of 10 to 10,000, preferably an integer of 20 to 10,000.

The amount of the compound represented by the formula (I) in the toner particles is preferably in the range of from 0.1 parts by weight to 5 parts by weight and more preferably in the range of from 0.1 parts by weight to 1 part by weight with respect to 100 parts by weight of the toner particles. When the amount of the compound represented by the formula (I) in the toner particles is less than 0.1 parts by weight with respect to 100 parts by weight of the toner particles, curing properties may be insufficient. When the amount thereof exceeds 5 parts by weight, the fixing properties may be deteriorated.

The weight average molecular weight of the compound represented by the formula (I) is preferably in the range of from 100 to 2,000,000, more preferably in the range of from 1,000 to 1,000,000, and still more preferably in the range of from 1,000 to 500,000. When the weight average molecular weight of the compound represented by the formula (I) is less than 100, the compound may be dissolved in the carrier liquid. When the weight average molecular weight thereof exceeds 2,000,000, curing failure may occur.

Crystalline Polyester Resin

The toner particles in the liquid developer according to the exemplary embodiment contain a resin having an unsaturated double bond (for example, a carbon-carbon double bond) as a binder resin. As the resin having an unsaturated double bond, a crystalline or amorphous polyester resin having an unsaturated double bond is exemplified. Examples of the crystalline polyester resin having an unsaturated double bond, which are not particularly limited, include a crystalline polyester resin obtained by polycondensing an unsaturated aliphatic dicarboxylic acid and an unsaturated aliphatic diol; a crystalline polyester resin obtained by polycondensing an unsaturated aliphatic dicarboxylic acid and an aliphatic diol; and a crystalline polyester resin obtained by polycondensing an aliphatic dicarboxylic acid and an unsaturated aliphatic diol. Among these, in terms of reactivity and the like, a crystalline polyester resin obtained by polycondensing an unsaturated aliphatic dicarboxylic acid and an unsaturated aliphatic diol is preferable. In the case where a polymer is obtained by copolymerizing other components with respect to a polyester main chain and the content of other components is 50% by weight or less, this copolymer is also referred to as a polyester resin.

It is considered that, in the case where a crystalline polyester resin having an unsaturated double bond is used as a binder resin, the melting point thereof is decreased, the fixing properties are improved, and the curing speed is increased.

Examples of the unsaturated aliphatic dicarboxylic acid include fumaric acid, maleic acid, citraconic acid, glutaconic acid, itaconic acid, 3-hexenoic diacid, an anhydride of these acids, and a lower alkyl ester of these acids, but the examples are not limited thereto. Among these, an unsaturated aliphatic dicarboxylic acid having 4 to 8 carbon atoms is preferable.

Examples of the unsaturated aliphatic diol include a 2-butene-1,4-diol, but the examples are not limited thereto. Among these, an unsaturated aliphatic diol having 2 to 8 carbon atoms is preferable. Further, the unsaturated aliphatic diol may be a mixture of geometric isomers.

Examples of the aliphatic dicarboxylic acid include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid, an anhydride of these acids, and a lower alkyl ester of these acids, but the examples are not limited thereto.

Examples of the aliphatic diol include ethyleneglycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, but the examples are not limited thereto.

The weight average molecular weight of the crystalline polyester resin having an unsaturated double bond is preferably in the range of from 5,000 to 200,000. When the weight average molecular weight of the crystalline polyester resin having an unsaturated double bond is less than 5,000, heat resistance may be deteriorated due to insufficient curing. When the weight average molecular weight thereof exceeds 200,000, fixing failure may occur.

The weight average molecular weight (Mw) is measured using gel permeation chromatography (GPC) . When the molecular weight is measured using GPC, LC-10AD (manufactured by Shimadzu Corporation) is used as a measuring device, a column (KF-805L, manufactured by Showadenkosya Co., Ltd.) is used, and measurement is performed with a tetrahydrofuran (THF) solvent. In addition, the weight average molecular weight is calculated using a molecular weight calibration curve obtained by a monodispersed polystyrene standard sample from the measurement results.

The acid value of the crystalline polyester resin having an unsaturated double bond is in the range of from 1 mgKOH/g to 80 mgKOH/g and preferably in the range of from 5 mgKOH/g to 50 mgKOH/g. When the acid value of the crystalline polyester resin having an unsaturated double bond is less than 1 mgKOH/g, particles may not be grown.

When the acid value thereof exceeds 80 mgKOH/g, particles may be aggregated. In addition, the acid value is measured by neutralization titration using a KOH/EtOH aqueous solution.

As method of preparing the crystalline polyester resin having an unsaturated double bond, which is not particularly limited, a general polyester polymerization method in which a dicarboxylic acid component and a diol component are reacted may be used.

In the exemplary embodiment of the invention, the "crystalline" of the "crystalline resin" means that a clear endothermic peak is exhibited without a stepwise endothermic change in differential scanning calorimetry (DSC) of a resin or a toner. Specifically, in differential scanning calorimetry (DSC) using a differential scanning calorimeter (device name: DSC-50 type, manufactured by Shimadzu Corporation) which has an automatic tangent line processing system, it may be said that a "clear" endothermic peak exists when the temperature from an onset point to the peak top of the endothermic peak is within 10° C. with respect to the measurement under the conditions that the temperature is increased at a temperature rising rate of 10° C./min, cooling is performed by liquid nitrogen, and the temperature is again increased at 10° C./min. A point of a flat portion of a base line in the DSC curve and a point of a flat portion of a falling portion from the base line are designated, and the intersection of a tangent line of the flat portions between both points is determined as an "onset point" by the automatic tangent line processing system. Meanwhile, a resin in which a stepwise endothermic change is recognized without a clear endothermic peak means an "amorphous resin" and is a resin which is a solid at room temperature and thermoplasticized at a temperature of higher than or equal to the glass transition temperature. Further, the "amorphous resin" does not show an endothermic peak corresponding to a crystalline melting point other than the stepwise endothermic point corresponding to glass transition in the differential scanning calorimetry (DSC).

The melting point of the crystalline polyester resin having an unsaturated double bond is preferably in the range of from 48° C. to 90° C. and more preferably in the range of from 50° C. to 80° C. When the melting point of the crystalline polyester resin having an unsaturated double bond is less than 48° C., heat resistance may be deteriorated. When the melting point thereof exceeds 90° C., low temperature fixing properties may be deteriorated. The melting point of the crystalline polyester resin is determined from the above-described "endothermic peak."

Among dicarboxylic acids to be used, an unsaturated aliphatic dicarboxylic acid may be used in combination with an aliphatic dicarboxylic acid, an aromatic dicarboxylic acid such as a terephthalic acid and an isophthalic acid, or the like, but it is preferable that 80% by mole or more of the unsaturated aliphatic dicaboxylic acid is contained in terms of curing properties and the like.

Among diols to be used, an unsaturated aliphatic diol may be used in combination with an aliphatic diol, an aromatic diol such as a bisphenol A and an alcohol-modified product of a bisphenol A, or the like, maybe combined, but it is preferable that 80% by mole or more of an unsaturated aliphatic diol is contained in terms of curing properties and the like.

The content of the crystalline polyester resin having an unsaturated double bond in toner particles, which is not particularly limited, for example, is in the range of from 30% by weight to 80% by weight with respect to the amount of the entirety of the toner particles. When the content of the crystalline polyester resin having an unsaturated double bond in the toner particles is less than 30% by weight, the curing failure may occur. When the content thereof exceeds 80% by weight, the fixing failure may occur.

With respect to the toner particles of the liquid developer according to the exemplary embodiment of the invention, examples of the resin having an unsaturated double bond other than the polyester resin having an unsaturated double bond include polystyrene, a styrene-acrylic resin such as a styrene-alkylacrylate 1 copolymer, or a styrene-alkylmethacrylatecopolymer, astyrene-acrylonitrile copolymer, a styrene-butadiene copolymer, a styrene-maleic anhydride copolymer, polyethylene, and polypropylene. Further, polyurethane, an epoxy resin, a silicone resin, polyamide, modified rosin, paraffin wax, and the like are exemplified. The content of other resins, which is not particularly limited, is in the range of from 1% by weight to 20% by weight with respect to the amount of the entirety of the toner particles.

In the toner particles of the liquid developer according to the exemplary embodiment of the invention, it is preferable that 30% by mole or more of a monomer unit constituting a resin having an unsaturated double bond contains an unsaturated double bond. In this manner, photocuring properties become excellent. In addition, it is preferable that the toner particles contain an amorphous resin and a crystalline resin as a resin having an unsaturated double bond and 30% by mole or more of a monomer unit constituting an amorphous resin and 30% by mole or more of a monomer unit constituting a crystalline resin each contain an unsaturated double bond. In this manner, photocuring properties become more excellent.

Photopolymerization Initiator

Examples of the photopolymerization initiator, which are not particularly limited, include acetophenone radical polymerization initiators such as IRGACURE 184 (phenyl 1-hydroxycyclohexylketone), IRGACURE 819 (phenyl bis (2,4,6-trimethylbenzoyl)phosphine oxide), IRGACURE 907 (2-methyl-1-[4-(methylthio) phenyl]-2-morpholino-1-propanone), and IRGACURE 369 (2-benzyl-2-(dimethylamino)-1-(4-morpholinophenyl) -1-butanone), IRGACURE 1173 (2-hydroxy-1-phenylethanone) (all manufactured by BASF Japan Ltd.), and IRGACURE 819 is preferable in terms of curing properties and the like.

The content of the photopolymerization initiator in toner particles, which is not particularly limited, is in the range of from 1% by weight to 10% by weight with respect to the amount of the entirety of the toner particles. When the content of the photopolymerization initiator in the toner particles is less than 1% by weight, curing failure may occur. When the content thereof exceeds 10% by weight, curing failure may occur.

Polyamine

Examples of the polyamine include polyalkyleneimines, polyallylamines, and polydiallylamines. Among these, polyalkyleneimines and polyallylamines are preferable in terms that polyalkyleneimines and polyallylamines are highly cationic and easily positively charged.

As the polyalkyleneimines, polyethyleneimine is exemplified.

As the polyallylamines, a polyallylamine represented by the formula (II) is exemplified.

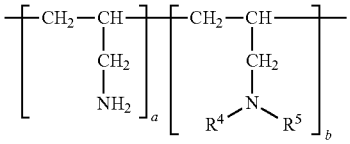

(II)

(In the formula (II), $R^4$ and $R^5$ each independently represent a hydrogen atom or an aliphatic hydrocarbon group having 1 to 20 carbon atoms; and a and b each independently represent an integer of 100 to 1,000.)

$R^4$ and $R^5$ each independently represent a hydrogen atom or an aliphatic hydrocarbon group having 1 to 20 carbon atoms, each preferably represent an aliphatic hydrocarbon group having 1 to 20 carbon atoms. Examples of the aliphatic hydrocarbon group having 1 to 20 carbon atoms include a methyl group, an ethyl group, a linear or branched propyl group, a butyl group, a pentyl group, a hexyl group, and an octyl group. Among these, a methyl group is preferable.

a and b each independently represent an integer of 1 to 10,000, preferably an integer of 5 to 1,000.

The amount of the polyamine with respect to the toner particles is preferably in the range of from 0.1 parts by weight to 10 parts by weight and more preferably in the range of from 0.5 parts by weight to 5 parts by weight with respect to 100 parts by weight of the toner particles. When the amount of the polyamine with respect to the toner particles is less than 0.1 parts by weight with respect to 100 parts by weight of the toner particles, resins may be aggregated. When the amount thereof exceeds 10 parts by weight, resins may be aggregated because of polyamine acting as a coagulant.

A weight average molecular weight of the polyamine is preferably in the range of from 5,000 to 100,000 and more preferably in the range of from 10,000 to 80,000. When the weight average molecular weight of the polyamine is less than 5,000, adsorption failure may occur with respect to a resin. When the weight average molecular weight thereof exceeds 100,000, polyamine may become easily aggregated.

It is preferable that the weight ratio of the amount of the compound represented by the formula (I) to the amount of the polyamine is in a range of from 1:20 to 10:1.

Core-Shell Structure

In the liquid developer according to the exemplary embodiment of the invention, it is preferable that toner particles have a core-shell structure. Further, it is preferable that the core contains a crystalline resin such as a crystalline polyester resin having an unsaturated double bond and a photopolymerization initiator, the shell contains an amorphous resin such as an amorphous polyester resin having an unsaturated double bond, the surface of the shell is treated by a polyamine, and the surface of a layer treated by a polyamine is further treated by the compound represented by the formula (I) above, when the toner particles have a core-shell structure. In this manner, deterioration of photocuring properties is further prevented in the case where toner particles are used as a liquid developer. In addition, when the toner has a core-shell structure and the shell contains an amorphous resin having an unsaturated double bond, dispersion failure of the toner particles is further prevented in the case where the toner particles are sued as a liquid developer.

Examples of the amorphous resin having an unsaturated double bond (for example, a carbon-carbon double bond) include a polyester resin having an unsaturated double bond, a styrene-butadiene block copolymer, natural rubber, and synthetic rubber such as isoprene rubber, or chloroprene rubber. Among these, a polyester resin is preferable in terms of fixing properties and the like.

The weight average molecular weight of the amorphous resin having an unsaturated double bond is preferably in the range of from 5,000 to 300,000. When the weight average molecular weight of the amorphous resin having an unsaturated double bond is less than 5,000, blocking resistance may be deteriorated due to insufficient curing. When the weight average molecular weight thereof exceeds 300,000, fixing failure may occur.

The content of the amorphous resin having an unsaturated double bond in the toner particles, which is not particularly limited, is in the range of from 5% by weight to 50% by weight with respect to the amount of the entirety of the toner particles. When the content of the amorphous resin having an unsaturated double bond in the toner particles is less than 5% by weight, curing failure may occur. When the content thereof exceeds 50% by weight, fixing failure may occur.

Other Components

Hereinafter, other constituent components of the toner particles in the liquid developer according to the exemplary embodiment of the invention will be described.

The toner particles according to the exemplary embodiment of the invention may contain other additives such as a colorant, a release agent, a charge-controlling agent, silica powder, and metal oxide, if necessary. These additives may be internally added by being kneaded and mixed into the binder resin, or be externally added by performing a mixing process after toner particles are obtained as the particles. In addition, the toner particles generally contain a colorant. However, when a toner needs to be transparent, a colorant may not be contained.

As the colorant, which is not particularly limited, a known pigment or dye is used. Specifically, respective pigments such as a yellow pigment, a magenta pigment, a cyan pigment and a black pigment as described below are used.

As the yellow pigment, a compound represented by a condensed azo compound, an isoindolinone compound, an anthraquinone compound, an azo metal complex compound, a methine compound, an allyl amide compound, and the like are used.

As the magenta pigment, a condensed azo compound, a diketopyrrolopyrrole compound, anthraquinone, a quinacridone compound, a basic dye lake compound, a naphthol compound, a benzimidazolone compound, a thioindigo compound, a pherylene compound, and the like are used.

As the cyan pigment, a copper phthalocyanine compound and a derivative thereof, an anthraquinone compound, a basic dye lake compound, and the like are used.

As the black pigment, carbon black, aniline black, acetylene black, iron black, and the like are used.

The content of the colorant is, for example, in the range of from 5% by weight to 20% by weight with respect to the entirety of the toner particles.

The release agent is not particularly limited, and, for example, vegetable wax such as carnauba wax, Japan wax, and rice bran wax; animal wax such as beeswax, insect wax, whale wax, and wool wax; mineral wax such as montan wax and ozoketrite, Fischer Tropsch Wax (FT wax) having ester in a branch, synthesized fatty acid solid ester wax such as special fatty acid ester and polyol ester; and synthetic wax such as paraffin wax, polyethylene wax, polypropylene wax, polytetrafluoroethylene wax, polyamide wax, and a silicone compound; and the like are included. The release agents may be used singly, or two or more types thereof may be used in combination.

The content of the release agent is, for example, in the range of from 0.1% by weight to 10% by weight with respect to the entirety of the toner particles.

The charge-controlling agent is not particularly limited, and a well-known charge-controlling agent in the related art is used. For example, a positive charge-controlling agent such as a nigrosine dye, a fatty acid-modified nigrosine dye, a carboxyl group containing fatty acid-modified nigrosine dye, quaternary ammonium salt, an amine compound, an amide compound, an imide compound, and an organic metal compound; and a negative charge-controlling agent such as a metal complex of oxycarboxylic acid, a metal complex of azo compound, a metal complex salt dye, and a salicylic acid derivative; are included. The charge-controlling agent may be used alone, or two or more kinds thereof may be used in combination.

The metal oxide is not particularly limited, and, for example, titanium oxide, aluminum oxide, magnesium oxide, zinc oxide, strontium titanate, barium titanate, magnesium titanate, and calcium titanate are included. The metal oxides may be used alone, or two or more kinds thereof may be used in combination.

Method of Preparing Toner

As a method of preparing a toner used in the exemplary embodiment of the invention, which is not particularly limited, a method of preparing a pulverized toner or an in-liquid emulsified and dried toner is exemplified. Further, a toner prepared using the method of preparing a pulverized toner or an in-liquid emulsified and dried toner may be pulverized in a carrier liquid.

Specifically, dry methods such as a kneading and pulverizing method of kneading, pulverizing, and classifying a binder resin, if necessary, a colorant, a release agent, and a charge-controlling agent; and a method of changing the shape of the particles obtained through the kneading and pulverizing method using a mechanical impact or thermal energy; a wet method such as an emulsion polymerization and aggregation method of emulsifying and polymerizing a polymerizable monomer of a binder resin, mixing the formed dispersion with a dispersion of, for example, a colorant, a release agent, or a charge-controlling agent if necessary, performing aggregation and coalescence through heating of the mixture, and obtaining toner base particles; a suspension polymerization method of suspending a polymerizable monomer for obtaining a binder resin and a solution, for example, if necessary, a colorant, a release agent, or a charge-controlling agent in an aqueous solvent to be polymerized; and a dissolution suspension method of suspending a binder resin, if necessary, a solution of, for example, a colorant, a release agent, or a charge-controlling agent in an aqueous solvent to be granulated are exemplified.

For example, a polyester resin having an unsaturated double bond, if necessary, other resins, a colorant, and other additives are put into a mixer such as a HENSCHEL mixer and mixed with each other, the mixture is melted and kneaded using a twin-screw extruder, a BANBURY mixer, a roll mill, a kneader or the like, the mixture is cooled using a drum flaker and coarsely pulverized using a pulverizer such as a hammer mill, and the resultant is further pulverized using a pulverizer such as a jet mill and classified using an air classifier, thereby obtaining a pulverized toner.

In addition, a polyester resin having an unsaturated double bond, if necessary, other resins, a colorant, or other additives are dissolved in a solvent such as ethyl acetate, the solution is emulsified in water to which a dispersion stabilizer such as calcium carbonate is added and suspended, the solvent is removed therefrom, and particles obtained by removing the dispersion stabilizer are filtered and dried, thereby obtaining an in-liquid emulsified and dried toner.

In addition, the combination ratio of respective materials (resin, colorant, other additives, and the like) at the time of obtaining the toner may be set depending on required characteristics, low temperature fixing properties, colors, and the like. The toner particles for a liquid developer may be obtained by pulverizing the obtained toner in carrier oil by using a well-known pulverizing apparatus such as a ball mill, a bead mill, and a high-pressure wet atomizing apparatus.

For example, a photopolymerization initiator is added to the toner particles obtained in the above-described manner and dispersed in a solvent such as alcohol such as methanol or the like, and the solvent is removed by reducing a pressure or the like, thereby obtaining a curable toner particles.

It is preferable that the toner particles according to the exemplary embodiment of the invention is prepared using resin fine particles obtained by dissolving a crystalline polyester resin having an acid group and an unsaturated double bond and a photopolymerization initiator in a solvent such as methyl ethyl ketone and performing phase inversion emulsification by adding the above-described polyamine, water, a surfactant and the like to the solvent. It is considered that crystallization of the crystalline polyester resin is prevented by the polyamine and thus granulation is improved.

Characteristics of Toner Particles

A volume average particle diameter D50v of the toner particles is preferably in the range of from 0.5 μm to 6.0 μm. When the volume average particle diameter D50v is in the above-described range, adhesion force is increased and developing properties are improved. Further, the resolution of an image is also improved. The volume average particle diameter D50v of the toner particles is more preferably in the range of from 0.8 μm to 5.0 μm and still more preferably in the range of from 1.0 μm to 4.0 μm.

The volume average particle diameter D50v, the number average particle size distribution index (GSDp), and the volume particles average particle size distribution index (GSDv) of the toner particles are measured using a laser diffraction/scattering particle size distribution measuring device, for example, LA920 (manufactured by Horiba, Ltd.). Cumulative distributions of the volume and the number are drawn from the small diameter side with respect to the particle size range (channel) divided based on the measured particle size distribution, and the particle diameter corresponding to 16% cumulation is defined as a volume particle diameter D16v and a number particle diameter D16p, the particle diameter corresponding to 50% cumulation is defined as a volume particle diameter D50v and a number particle diameter D50p, and the particle diameter corresponding to 84% cumulation is defined as a volume particle diameter D84v and a number particle diameter D84p. Using these definitions, the volume average particle size distribution index (GSDv) is calculated as $(D84v/D16v)^{1/2}$ and the number average particle size distribution index (GSDp) is calculated as $(D84p/D16p)^{1/2}$.

Liquid Developer

The liquid developer according to the exemplary embodiment of the invention contains the above-described toner particles and a carrier liquid. In the exemplary embodiment of the invention, the toner particles contain a resin having an unsaturated double bond, the compound represented by the formula (I) above, and a photopolymerization initiator and the surface thereof is treated by a polyamine. Further, curing of an image is sufficiently promoted even in the atmosphere by curing an unsaturated double bond of a resin having an unsaturated double bond and a thiol group of the compound represented by the formula (I) above through photopolymerization, and thus an image with excellent heat resistance or the like may be obtained even in the presence of a carrier liquid. It is considered that curing contraction is reduced and an image is sufficiently cured in the atmosphere by carrying out a thiol-ene reaction.

Carrier Liquid

A carrier liquid is an insulating liquid for dispersing toner particles and is not particularly limited, but an insulating liquid having silicone oil as a main component is preferable. Silicone oil may be used alone or a mixed solution of silicone oil with other insulating liquid may be used. Examples of the silicone oil include KF96 (manufactured by Shin-Etsu Chemical Co., Ltd.), SH200, SH344 (both manufactured by Dow Corning Toray Co., Ltd.), and TSF451 (manufactured by GE Toshiba Silicones Co., Ltd.). Further, the liquid which may be mixed is not particularly limited and examples thereof include an aliphatic hydrocarbon solvent such as paraffin oil (as the commercially available products, MORESCO WHITE MT-30P, MORESCO WHITE P40, and MORESCO WHITE P70 manufactured by MATSUMURA OIL Co. , Ltd. , and ISOPAR L and ISOPAR M manufactured by Exxon Chemical Co., Ltd.); a hydrocarbon solvent such as naphthenic oil (as the commercially available products, EXXSOL D80, EXXSOL D110, EXXSOL D130 manufactured by Exxon Chemical Co., Ltd., NAPHTESOL L, NAPHTESOL M, NAPHTESOL H, New NAPHTESOL 160, New NAPHTESOL 200, New NAPHTESOL 220, and New NAPHTESOL MS-20P manufactured by Nippon Petrochemical Co., Ltd.). An aromatic compound such as toluene may be contained in the above-described examples. Further, the expression "containing silicone oil as a main component" means that 50% by weight or more silicone oil is contained in the carrier liquid.

For example, the volume resistivity of the carrier liquid is included in the range of from $1.0\times10^{10}$ Ω·cm to $1.0\times10^{14}$ Ω·cm, and may be in the range of from $1.0\times10^{10}$ Ω·cm to $1.0\times10^{13}$ Ω·cm.

The carrier liquid may contain various types of auxiliary materials, for example, a dispersion agent, an emulsifying agent, a surfactant, a stabilizing agent, a wetting agent, a thickening agent, a foaming agent, an antifoaming agent, a coagulant, a gelling agent, an anti-settling agent, a charge-controlling agent, an antistatic agent, an antioxidant, a softening agent, a plasticizer, a filler, a flavoring agent, an adhesion-preventing agent, and a release agent.

Method of Preparing Liquid Developer

The liquid developer according to the exemplary embodiment of the invention is obtained by mixing the above-described toner particles, a carrier liquid and the compound represented by the formula (I) above using a disperser such as a ball mill, a sand mill, an attritor, or a bead mill, pulverizing the mixture, and dispersing the toner particles in the carrier liquid. For example, the compound represented by the formula (I) is mixed with a carrier liquid, toner particles whose surface is treated and a carrier liquid are added to the mixed solution, and the toner particles may be dispersed therein. In addition, the dispersion of the toner particles in the carrier liquid is not limited to those using the disperser, and the dispersion may be performed by rotating special stirring blades at a high speed, by shearing force of a rotor and stator known as a homogenizer, or by ultrasonic waves.

From a viewpoint of appropriately controlling a viscosity of the developer and smoothly circulating the developing liquid in a developing machine, the concentration of the toner particles in the carrier liquid is preferably in the range of from 0.5% by weight to 40% by weight, and more preferably in the range of from 1% by weight to 30% by weight.

Thereafter, the obtained dispersion may be filtered with a filter such as a membrane filter with a pore diameter of approximately 100 μm to remove waste and coarse particles.

Developer Cartridge, Process Cartridge, and Image Forming Apparatus

An image forming apparatus according to the exemplary embodiment of the invention includes an image holding member (hereinafter, also referred to as a "photoreceptor"); a charging unit that charges the surface of the image holding member; a latent image forming unit that forms a latent image (electrostatic latent image) on the surface of the image holding member; a developing unit that develops the latent image formed on the surface of the image holding member using the liquid developer according to the exemplary embodiment of the invention which is held on the surface of a developer holding member and forms a toner image; a transfer unit that transfers the toner image formed on the surface of the image holding member onto a recording medium; a fixing unit that fixes the toner image transferred to the recording medium to the recording medium and forms a fixed image; and a curing unit that cures the fixed image.

In the image forming apparatus, for example, may have a portion including a developing unit may have a cartridge structure (process cartridge) which is detachable from a main member of the image forming apparatus. The process cartridge is not particularly limited as long as the process cartridge accommodates the liquid developer according to the exemplary embodiment of the invention. The process cartridge accommodates the liquid developer according to the exemplary embodiment of the invention, includes a developing unit that develops the latent image formed on the image holding member with the liquid developer and forms the toner image, and is detachable from the image forming apparatus.

In addition, the developer cartridge according to the embodiment is not particularly limited as long as the developer cartridge accommodates the liquid developer according to the exemplary embodiment of the invention. The developer cartridge accommodates the liquid developer according to the exemplary embodiment of the invention, and is detachable from an image forming apparatus including the developing unit that develops the latent image formed on the image holding member with the liquid developer to forma toner image. The developer cartridge may have a container which stores the liquid developer.

Hereinafter, an example of an image forming apparatus using the liquid developer according to the exemplary embodiment of the invention will be described with reference to the accompanying figure.

FIG. 1 is a view schematically illustrating an example of the image forming apparatus according to the exemplary embodiment of the invention. An image forming apparatus 100 includes a photoreceptor (image holding member) 10; a charging device (charging unit) 20; an exposure device (latent image forming unit) 12; a developing device (developing unit) 14; an intermediate transfer member (transfer unit) 16; a cleaner (cleaning unit) 18; a transfer fixation roller (transfer unit, fixing unit) 28; and a curing device (curing unit) 32. The photoreceptor 10 is cylindrical and the charging device 20, the exposure device 12, the developing device 14, the intermediate transfer member 16, and the cleaner 18 are sequentially provided on the outer periphery of the photoreceptor 10.

Hereinafter, operations of the image forming apparatus 100 are described.

The charging device 20 charges the surface of the photoreceptor 10 to a predetermined potential (charging process), and the exposure device 12 forms a latent image (electrostatic latent image) by exposing the charged surface with laser beams based on an image signal (latent image forming process).

The developing device 14 includes a developing roller 14*a* and a developer accommodating container 14*b*. The developing roller 14*a* is installed so that a portion thereof is immersed in a liquid developer 24 accommodated in the developer accommodating container 14*b*. The liquid developer 24 includes an insulating carrier liquid, toner particles containing a binder resin, and the charge-controlling agent.

Though the toner particles are dispersed in the liquid developer 24, for example, the positional variation of concentrations of the toner particles in the liquid developer 24 is decreased, for example, by continuously stirring the liquid developer 24 with a stirring member provided in the developer accommodating container 14*b*. Accordingly, the liquid developer 24 in which the positional variation of the concentrations of the toner particles is decreased is supplied to the developing roller 14*a* that rotates in an arrow A direction in FIG. 1.

The liquid developer 24 supplied to the developing roller 14*a* is transferred to the photoreceptor 10 in a state of being regulated to a certain supply amount by a regulation member, and is supplied to the electrostatic latent image in a position in which the developing roller 14*a* and the photoreceptor 10 are close to each other (or contact with each other). Accordingly, the electrostatic latent image is developed to become a toner image 26 (developing process).

The developed toner image 26 is transported to the photoreceptor 10 that rotates in an arrow B direction in FIG. 1, and is transported to paper (recording medium) 30. However, according to the exemplary embodiment of the invention, before the toner image is transferred to the paper 30, in order to enhance the transfer efficiency to the recording medium together with the separation efficiency of the toner image from the photoreceptor 10 and to cause the toner image to be fixed at the same time as being transferred to the recording medium, the toner image is once transferred to the intermediate transfer member 16 (intermediate transfer process). At this point, the circumferential speed difference between the photoreceptor 10 and the intermediate transfer member 16 may be provided.

Subsequently, the toner image transported in an arrow C direction by the intermediate transfer member 16 is fixed at the same time as being transferred to the paper 30 in a contact position with the transfer fixation roller 28 (transfer process and fixing process). The paper 30 is interposed between the transfer fixation roller 28 and the intermediate transfer member 16, and the toner image on the intermediate transfer member 16 is in close contact with the paper 30. Accordingly, the toner image is transferred to the paper 30, and the toner image is fixed on the paper, to be a fixed image 29. It is preferable that the toner image be fixed by providing a heating member on the transfer fixation roller 28 and pressurizing and heating the toner image. The fixation temperature is, generally, in the range of from 120° C. to 200° C.

If the intermediate transfer member 16 has a roller shape as illustrated in FIG. 1, the intermediate transfer member 16 and the transfer fixation roller 28 configure a roller pair. Therefore, the intermediate transfer member 16 and the transfer fixation roller 28 respectively correspond to a fixation roller and a pressurization roller in a fixing device, and exhibit a fixing function. That is, if the paper 30 passes through a nip formed between the intermediate transfer member 16 and the transfer fixation roller 28, the toner image is transferred and also is heated and pressurized with respect to the intermediate transfer member 16 by the transfer fixation roller 28. Accordingly, the toner image permeates into fibers of the paper 30 while the binder resins in the toner particles that configure the toner image are softened, so that the fixed image 29 is formed on the paper 30.

According to the exemplary embodiment of the invention, the image is transferred to and fixed on the paper 30 at the same time, but the transfer process and the fixation process maybe respectively performed so that the image is fixed after being transferred. In this case, the transfer roller that transfers the toner image from the photoreceptor 10 has a function corresponding to the intermediate transfer member 16.

Next, the fixed image is cured by the curing device 32 (curing process). The curing is performed by applying electromagnetic waves such as UV rays (UV) or electron beams. As the curing device 32, a UV irradiation device or an electron beam irradiation device is exemplified.

Meanwhile, in the photoreceptor 10 that transfers the toner image 26 to the intermediate transfer member 16, remaining toner particles that are not transferred are moved to a contact position with the cleaner 18, and collected by the cleaner 18. In addition, if the transfer efficiency is near 100%, and the remaining toner does not cause problems, the cleaner 18 may not be provided.

The image forming apparatus 100 may include an erasing device (not illustrated) that erases the latent image on the surface of the photoreceptor 10 after transfer and before next charging.

All of the charging device 20, the exposure device 12, the developing device 14, the intermediate transfer member 16, the transfer fixation roller 28, the curing device 32, and the cleaner 18 which are included in the image forming apparatus 100 may be operated in synchronization with the rotation speed of the photoreceptor 10.

The image forming apparatus according to the exemplary embodiment of the invention may include a transparent image forming unit that forms a transparent image using the toner according to the exemplary embodiment of the invention as a transparent toner on an image support such as a blanket, a transfer roller or a transfer belt; a colored image forming unit that forms a colored image (base layer) containing colored particles having one or more colors on the transparent image; a transfer unit that transfers the formed image to a recording medium; a melting unit that melts the transparent image on the recording medium; and a curing unit that cures the melted image by applying UV rays and heating.

When toner particles containing a resin having an unsaturated double bond, the compound represented by the formula (I), and a photopolymerization initiator and whose surface is treated by a polyamine are used, and an unsaturated double bond of a resin having an unsaturated double bond and a thiol group of the compound represented by the formula (I) are cured through photopolymerization, curing of an image is sufficiently promoted even in the atmosphere and thus an image with excellent heat resistance or the like may be obtained even in the presence of a carrier liquid. It is considered that curing contraction is minimized and an image is sufficiently cured in the atmosphere by using a thiol-ene reaction.

EXAMPLES

Hereinafter, the invention is more specifically described with reference to Examples and Comparative Examples, but the invention is not limited to the Examples below.

Synthesis of Amorphous Polyester Resin 1

Fumaric acid: 30% by mole

Terephthalic acid: 18% by mole

Trimellitic anhydride: 2% by mole

Bisphenol A ethylene oxide two-molar adduct: 20% by mole

Bisphenol A propylene oxide two-molar adduct: 30% by mole

Catalyst (trade name: ORGATICS TC-400, manufactured by Matsumoto Fine Chemical Co., Ltd.): 0.3% by mole The above-described components are mixed in a flask, heated to 170° C. in a nitrogen atmosphere, stirred for 1 hour, and dehydrated and condensed at 200 Pa and 200° C. for 5 hours, thereby obtaining an amorphous polyester resin 1 having an unsaturated double bond. The acid value of the obtained polyester resin 1 is 15 mgKOH/g, the glass transition temperature (Tg) thereof obtained by using a differential scanning calorimeter (DSC) is 59° C., and the weight average molecular weight (Mw) thereof obtained by using GPC is 33,000.

Synthesis of Amorphous Polyester Resin 2

Fumaric acid:50% by mole

Bisphenol A ethylene oxide two-molar adduct: 20% by mole

Bisphenol A propylene oxide two-molar adduct: 30% by mole

Catalyst (trade name: ORGATICS TC-400, manufactured by Matsumoto Fine Chemical Co., Ltd.): 0.3% by mole The above-described components are mixed in a flask, heated to 170° C. in a nitrogen atmosphere, stirred for 1 hour, and dehydrated and condensed at 200 Pa and 200° C. for 5 hours, thereby obtaining an amorphous polyester resin 2 having an unsaturated double bond. The acid value of the obtained polyester resin 2 is 14 mgKOH/g, the glass transition temperature (Tg) thereof obtained by using a differential scanning calorimeter (DSC) is 62° C., and the weight average molecular weight (Mw) thereof obtained by using GPC is 26,000.

Synthesis of Amorphous Polyester Resin 3

Terephthalic Acid: 50% by mole

Bisphenol A Ethylene Oxide Two-Molar Adduct: 20% by mole

Bisphenol A Propylene Oxide Two-Molar Adduct: 30% by mole

Catalyst (trade name: ORGATICS TC-400, manufactured by Matsumoto Fine Chemical Co., Ltd.): 0.3% by mole The above-described components are mixed in a flask, heated to 170° C. in a nitrogen atmosphere, stirred for 1 hour, and dehydrated and condensed at 200 Pa and 200° C. for 5 hours, thereby obtaining an amorphous polyester resin 3. The acid value of the obtained polyester resin 3 is 12 mgKOH/g, the glass transition temperature (Tg) thereof obtained by using a differential scanning calorimeter (DSC) is 65° C., and the weight average molecular weight (Mw) thereof obtained by using GPC is 57,000.

Synthesis of Amorphous Polyester Resin 4

Terephthalic Acid: 30% by mole

Fumaric Acid: 20% by mole

Bisphenol A Ethylene Oxide Two-Molar Adduct: 20% by mole

Bisphenol A propylene oxide two-molar adduct: 30% by mole

Catalyst (trade name: ORGATICS TC-400, manufactured by Matsumoto Fine Chemical Co., Ltd.): 0.3% by mole The above-described components are mixed in a flask, heated to 170° C. in a nitrogen atmosphere, stirred for 1 hour, and dehydrated and condensed at 200 Pa and 200° C. for 5 hours, thereby obtaining an amorphous polyester resin 4. The acid value of the obtained polyester resin 4 is 13 mgKOH/g, the glass transition temperature (Tg) thereof obtained by using a differential scanning calorimeter (DSC) is 68° C., and the weight average molecular weight (Mw) thereof obtained by using GPC is 35,000.

Synthesis of Crystalline Polyester Resin 1

Fumaric Acid: 50% by mole

Hexanediol: 50% by mole

Catalyst (trade name: ORGATICS TC-400, manufactured by Matsumoto Fine Chemical Co., Ltd.): 0.5% by mole The above-described components are mixed in a three-necked flask and heated and stirred at 180° C. for 2 hours in a nitrogen atmosphere. Further, the mixture is heated and stirred at 200 Pa and 180° C. for 4 hours. After the reaction is finished, the reaction liquid is poured into a beaker (630 parts by weight of methanol) and crystals are precipitated. The crystals are filtered through suction filtration and washed with 400 parts by weight of methanol. The crystals are dried in a vacuum at 30° C. for 18 hours, thereby obtaining a crystalline polyester resin 1 having an unsaturated double bond. When the resin is measured by a polystyrene calibration curve using gel permeation chromatography LC-10AD (manufactured by Shimadzu Corporation) at a flow rate of 1 mL/min, the weight average molecular weight thereof is 18600 and the acid value thereof is 40 mgKOH/g.

Synthesis of Crystalline Polyester Resin 2

Fumaric Acid: 20% by mole

Adipic Acid: 30% by mole

Hexanediol: 50% by mole

Catalyst (trade name: ORGATICS TC-400, manufactured by Matsumoto Fine Chemical Co., Ltd.): 0.5% by mole The above-described components are mixed in a three-necked flask and heated and stirred at 180° C. for 2 hours in a nitrogen atmosphere. Further, the mixture is heated and stirred at 200 Pa and 180° C. for 4 hours. After the reaction is finished, the reaction liquid is poured into a beaker (600 parts by weight of methanol) and crystals are precipitated. The crystals are filtered through suction filtration and washed with 400 parts by weight of methanol. The crystals are dried in a vacuum at 30° C. for 18 hours, thereby obtaining a crystalline polyester resin 2 having an unsaturated double bond. When the resin is measured by a polystyrene calibration curve using gel permeation chromatography LC-10AD (manufactured by Shimadzu Corporation) at a flow rate of 1 mL/min, the weight average molecular weight thereof is 19,000 and the acid value thereof is 45 mgKOH/g.

Preparation of Latex

Preparation of Fine Particles 1 Using Amorphous Polyester Resin 1

The amorphous polyester resin 1 (140 parts by weight) is put into a separable flask and IRGACURE 819 (13 parts by weight, manufactured by BASF Japan Ltd.) as a photopolymerization initiator, methyl ethyl ketone (130 parts by weight, manufactured by KANTO CHEMICAL CO., INC.), and isopropyl alcohol (17 parts by weight, manufactured by JUNSEI CHEMICAL CO., LTD.) are added thereto and then dissolved therein. 5.0 parts by weight of 10 wt % ammonium water are added dropwise and 280 parts by weight of water are added dropwise, thereby obtaining fine particles. Next, a 20 wt % aqueous solution of a surfactant DOWFAX 2A1 and (5 parts by weight, manufactured by Dow Chemical Company) is added thereto, thereby obtaining 560 parts by weight of fine particles 1 having a volume average particle diameter Dv50 of 160 nm.

Preparation of fine Particles 2 using Amorphous Polyester Resin 2

The amorphous polyester resin 2 (140 parts by weight) is put into a separable flask and IRGACURE 819 (13 parts by weight, manufactured by BASF Japan Ltd.) as a photopolymerization initiator, methyl ethyl ketone (120 parts by weight, manufactured by KANTO CHEMICAL CO., INC.), and isopropyl alcohol (17 parts by weight, manufactured by JUNSEI CHEMICAL CO., LTD.) are added thereto and then dissolved therein at a reflux temperature. After the temperature is cooled to 40° C., 5.0 parts by weight of 10 wt % ammonium water are added dropwise, 280 parts by weight of water are added dropwise, and a 20 wt % aqueous solution of a surfactant DOWFAX 2A1 (5 parts by weight, manufactured by Dow Chemical Company) are added thereto, thereby obtaining 560 parts by weight of fine particles 2 having a volume average particle diameter Dv50 of 130 nm.

Preparation of Fine Particles 3 Using Amorphous Polyester Resin 3

The amorphous polyester resin 3 (140 parts by weight) is put into a separable flask and IRGACURE 819 (13 parts by weight, manufactured by BASF Japan Ltd.) as a photopolymerization initiator, KARENZ MTPE1 (10 parts by weight, manufactured by SHOWA DENKO K.K., tetrafunctional, pentaerythritol compound) as a thiol compound, methyl ethyl ketone (120 parts by weight, manufactured by KANTO CHEMICAL CO., INC.), and isopropyl alcohol (17 parts by weight, manufactured by JUNSEI CHEMICAL CO., LTD.) are added thereto followed by dissolving at a reflux temperature. After the temperature is cooled to 40° C., 5.0 parts by weight of 10 wt % ammonium water are added dropwise, 280 parts by weight of water are added dropwise, and a 20 wt % aqueous solution of a surfactant DOWFAX 2A1 (5 parts by weight, manufactured by Dow Chemical Company) are added thereto, thereby obtaining 560 parts by weight of fine particles 3 having a volume average particle diameter Dv50 of 130 nm.

Preparation of Fine Particles 4A Using Crystalline Polyester Resin 1

The crystalline polyester resin 1 (140 parts by weight) is put into a separable flask, methyl ethyl ketone (160 parts by weight, manufactured by KANTO CHEMICAL CO., INC.) is added thereto, and the crystalline polyester resin 1 is dissolved therein at a reflux temperature. After the temperature is cooled to 40° C., 5.0 parts by weight of 10 wt % ammonium water is added dropwise, 280 parts by weight of water is added dropwise, and a surfactant DOWFAX 2A1 and a 20 wt % aqueous solution (5 parts by weight, manufactured by Dow Chemical Company) are added thereto, thereby obtaining 580 parts by weight of fine particles 4A having a volume average particle diameter Dv50 of 160 nm.

Preparation of fine Particles 4B Using Crystalline Polyester Resin 2

The crystalline polyester resin 2 (140 parts by weight) is put into a separable flask, methyl ethyl ketone (160 parts by weight, manufactured by KANTO CHEMICAL CO., INC.) is added thereto, followed by dissolving at a reflux temperature. After the temperature is cooled to 40° C., 5.0 parts by weight of 10 wt % ammonium water are added dropwise, 280 parts by weight of water are added dropwise, and a 20 wt % aqueous solution of a surfactant DOWFAX 2A1 (5 parts by weight, manufactured by Dow Chemical Company) are added thereto, thereby obtaining 580 parts by weight of fine particles 4B having a volume average particle diameter Dv50 of 160 nm.

Preparation of Fine Particles 5 Using Amorphous Polyester Resin 1

The amorphous polyester resin 1 (140 parts by weight) is put into a separable flask and IRGACURE 819 (13 parts by weight, manufactured by BASF Japan Ltd.) as a photopolymerization initiator, KARENZ MTPE1 (10 parts by weight, manufactured by SHOWA DENKO K.K., tetrafunctional, pentaerythritol compound) as a thiol compound, methyl ethyl ketone (130 parts by weight, manufactured by KANTO CHEMICAL CO., INC.), and isopropyl alcohol (17 parts by weight, manufactured by JUNSEI CHEMICAL CO., LTD.) are added thereto and then dissolved therein. 5.0 parts by weight of 10 wt % ammonium water are added dropwise, 280 parts by weight of water are added dropwise, and a 20 wt % aqueous solution of a surfactant DOWFAX 2A1 (5 parts by weight, manufactured by Dow Chemical Company) are added thereto, thereby obtaining 580 parts by weight of fine particles 5 having a volume average particle diameter Dv50 of 170 nm.

Preparation of Fine Particles 6 Using Amorphous Polyester Resin 4

The amorphous polyester resin 4 (140 parts by weight) is put into a separable flask and IRGACURE 819 (13 parts by weight, manufactured by BASF Japan Ltd.) as a photopolymerization initiator, methyl ethyl ketone (130 parts by weight, manufactured by KANTO CHEMICAL CO., INC.), and isopropyl alcohol (17 parts by weight, manufactured by JUNSEI CHEMICAL CO., LTD.) are added thereto and then dissolved therein. 5.0 parts by weight of 10 wt % ammonium water are added dropwise, 280 parts by weight of water are added dropwise, and a 20 wt % aqueous solution of a surfactant DOWFAX 2A1 (5 parts by weight, manufactured by Dow Chemical Company) are added thereto, thereby obtaining 580 parts by weight of fine particles 6 having a volume average particle diameter Dv50 of 160 nm.

Preparation of Fine Particles 7 Using Amorphous Polyester Resin 3

The amorphous polyester resin 3 (140 parts by weight) is put into a separable flask and methyl ethyl ketone (160 parts by weight, manufactured by KANTO CHEMICAL CO., INC.) is added thereto and then dissolved therein at a reflux temperature. The temperature is cooled to 40° C., 5.0 parts by weight of 10 wt % ammonium water are added dropwise, 280 parts by weight of water are added dropwise, and a 20 wt % aqueous solution of a surfactant DOWFAX 2A1 (5 parts by weight, manufactured by Dow Chemical Company) are added thereto, thereby obtaining 580 parts by weight of fine particles 7 having a volume average particle diameter Dv50 of 160 nm.

Example 1

Preparation of Toner Particles 1 (No Shell) and Liquid Developer 1

100 parts by weight of fine particles 1 (amorphous polyester resin 1 having an unsaturated double bond) are put into a separable flask and a 3 wt % sodium sulfate aqueous solution is added dropwise until the volume average particle diameter thereof becomes 4.0 μm. Subsequently, 100 parts by weight of stopped water are added and the reaction is stopped. Next, methyl ethyl ketone and isopropyl alcohol are desolvated while sending the air at 25° C., thereby obtaining a toner dispersion. The toner dispersion is suction-filtered and then a cake is obtained. Next, 300 parts by weight of taken-out water are added to the cake and the solution is stirred for 10 minutes in an environment of ultrasonic waves. The pH thereof is adjusted to be 3 using 1 N of hydrochloric acid, a 1 wt % polyethyleneimine (PEI, manufactured by JUNSEI CHEMICAL CO., LTD., weight average molecular weight: 70,000) aqueous solution is added to toner particles and stirred for 1 hour, and the mixture is washed with water and then freeze-dried for 40 hours, thereby obtaining 90 parts by weight of PEI-treated toner particles having a volume average particle diameter Dv50 of 4.0 μm. 0.1% by weight of the compound represented by the formula (I) ($R^1$ and $R^2$ each independently represent a dodecamethylene group, $R^3$ represents a trimethylene group, and m+n is 1,000) is added to 15 parts by weight of the PEI-treated toner particles, silicone oil (trade name: KF96-20CS, manufactured by Shin-Etsu Chemical Co., Ltd.) is further added thereto as a carrier liquid, and the total amount is adjusted to 50 parts by weight. Further, the mixture is stirred using ULTRA-TURRAX T50 at 8800 rpm for 1 minute, thereby obtaining a liquid developer 1.

Example 2

Preparation of Toner Particles 2 (No Shell) and Liquid Developer 2

100 parts by weight of fine particles 1 (amorphous polyester resin 1 having an unsaturated double bond) and 50 parts by weight of fine particles 4A (crystalline polyester resin 1 having an unsaturated double bond) are put into a separable flask and a 3 wt % sodium sulfate aqueous solution is added dropwise until the volume average particle diameter thereof becomes 4.0 μm. Subsequently, 100 parts by weight of stopped water are added and the reaction is stopped. Next, methyl ethyl ketone and isopropyl alcohol are desolvated while sending the air at 25° C., thereby obtaining a toner dispersion. The toner dispersion is suction-filtered and then a cake is obtained. Next, 300 parts by weight of taken-out water are added to the cake and the solution is stirred for 10 minutes in an environment of ultrasonic waves. The pH thereof is adjusted to be 3 using 1 N of hydrochloric acid, a 1 wt % polyethyleneimine (PEI, manufactured by JUNSEI CHEMICAL CO., LTD., weight average molecular weight: 70,000) aqueous solution is added to toner particles and stirred for 1 hour, and the mixture is washed with water and then freeze-dried for 40 hours, thereby obtaining 90 parts by weight of PEI-treated toner particles having a volume average particle diameter Dv50 of 4.0 μm. 0.1% by weight of the compound represented by the formula (I) ($R^1$ and $R^2$ each independently represent a dodecamethylene group, $R^3$ represents an ethylene group, and m+n is 1,000) is added to 15 parts by weight of the PEI-treated toner particles, silicone oil (trade name: KF96-20CS, manufactured by Shin-Etsu Chemical Co., Ltd.) is further added thereto as a carrier liquid, and the total amount is adjusted to 50 parts by weight. Further, the mixture is stirred using ULTRA-TURRAX T50 at 8800 rpm for 1 minute, thereby obtaining a liquid developer 2.

Example 3

Preparation of Toner Particles 3 (No Shell) and Liquid Developer 3

Toner particles 3 and a liquid developer 3 are obtained in the same manner as in Example 2 except that a compound represented by the formula (I) ($R^1$ and $R^2$ each independently represent an ethylene group, $R^3$ represents a trimethylene group, and m+n is 1,000) is used in place of the compound represented by the formula (I) ($R^1$ and $R^2$ each independently represent a dodecamethylene group, $R^3$ represents an ethylene group, and m+n is 1,000) in Example 2.

Example 4

Preparation of Toner Particles 4 (No Shell) and Liquid Developer 4

Toner particles 4 and a liquid developer 4 are obtained in the same manner as in Example 2 except that a compound represented by the formula (I) ($R^1$ and $R^2$ each independently represent a dodecamethylene group, $R^3$ represents a trimethylene group, and m+n is 10,000) is used in place of the compound represented by the formula (I) ($R^1$ and $R^2$ each independently represent a dodecamethylene group, $R^3$ represents an ethylene group, and m+n is 1,000) in Example 2.

Example 5

Preparation of Toner Particles 5 (No Shell) and Liquid Developer 5

Toner particles 5 and a liquid developer 5 are obtained in the same manner as in Example 2 except that a compound represented by the formula (I) (R6$^1$ and $R^2$ each independently represent a dodecamethylene group, $R^3$ represents an ethylene group, and m+n is 20) is used in place of the compound represented by the formula (I) ($R^1$ and $R^2$ each independently represent a dodecamethylene group, $R^3$ represents an ethylene group, and m+n is 1,000) in Example 2.

Example 6

Preparation of toner Particles 6 (No Shell) and Liquid Developer 6

100 parts by weight of fine particles 6 (amorphous polyester resin 4 having an unsaturated double bond) and 50 parts by weight of fine particles 4B (crystalline polyester resin 2 having an unsaturated double bond) are put into a separable flask and a 3 wt % sodium sulfate aqueous solution is added dropwise until the volume average particle diameter thereof becomes 4.0 μm. Subsequently, 100 parts by weight of stopped water are added and the reaction is stopped. Next, methyl ethyl ketone and isopropyl alcohol are desolvated while sending the air at 25° C., thereby obtaining a toner dispersion. The toner dispersion is suctioned and filtered and then a cake is obtained. Next, 300 parts by weight of taken-out water are added to the cake and the solution is stirred for 10 minutes in an environment of ultrasonic waves. The pH thereof is adjusted to be 3 using 1 N of hydrochloric acid, a 1 wt % polyethyleneimine (PEI, manufactured by JUNSEI CHEMICAL CO., LTD., weight average molecular weight: 70,000) aqueous solution is added to toner particles and stirred for 1 hour, and the mixture is washed with water and then freeze-dried for 40 hours, thereby obtaining 90 parts by weight of PEI-treated toner particles 6 having a volume average particle diameter Dv50 of 4.0 μm. 0.1% by weight of the compound represented by the formula (I) ($R^1$ and $R^2$ each independently represent a dodecamethylene group, $R^3$ represents an ethylene group, and m+n is 1,000) is added to 15 parts by weight of the PEI-treated toner particles, silicone oil (trade name: KF96-20CS, manufactured by Shin-Etsu Chemical Co., Ltd.) is further added thereto as a carrier liquid, and the total amount is adjusted to 50 parts by weight. Further, the mixture is stirred using ULTRA-TURRAX T50 at 8800 rpm for 1 minute, thereby obtaining a liquid developer 6.

Example 7

Preparation of Toner Particles 7 (Core-Shell Structure) and Liquid Developer 7

50 parts by weight of fine particles 2 (amorphous polyester resin 2 having an unsaturated double bond) and 50 parts by weight of fine particles 4A (crystalline polyester resin 1) are put into a separable flask and a 3 wt % sodium sulfate aqueous solution is added dropwise until the volume average particle diameter thereof becomes 3.0 μm. Subsequently, 30 parts by weight of fine particles 7 are added to form a shell and the volume average particle diameter thereof is adjusted to 4.0 μm using 1 wt % sodium sulfate aqueous solution. 100 parts by weight of stopped water are added and the reaction is stopped. Next, methyl ethyl ketone and isopropyl alcohol are desolvated while sending the air at 25° C., thereby obtaining a toner dispersion. The toner dispersion is suctioned and filtered and then a cake is obtained. Next, 300 parts by weight of taken-out water are added to the cake and the solution is stirred for 10 minutes in an environment of ultrasonic waves. The pH thereof is adjusted to be 3 using 1 N of hydrochloric acid, a 1 wt % polyethyleneimine (PEI, manufactured by JUNSEI CHEMICAL CO., LTD., weight average molecular weight: 70,000) aqueous solution is added to toner particles and stirred for hour, and the mixture is washed with water and then freeze-dried for 40 hours, thereby obtaining 90 parts by weight of PEI-treated toner particles 6 having a volume average particle diameter Dv50 of 4.0 μm. 0.1% by weight of the compound represented by the formula (I) ($R^1$ and $R^2$ each independently represent a dodecamethylene group, $R^3$ represents an ethylene group, and m+n is 1,000) is added to 15 parts by weight of the PEI-treated toner particles, silicone oil (trade name: KF96-20CS, manufactured by Shin-Etsu Chemical Co., Ltd.) is further added thereto as a carrier liquid, and the total amount is adjusted to 50 parts by weight. Further, the mixture is stirred using ULTRA-TURRAX T50 at 8800 rpm for 1 minute, thereby obtaining a liquid developer 7.

Comparative Example 1

Preparation of Comparative Toner Particles 1 and Comparative Liquid Developer 1

100 parts by weight of fine particles 3 (amorphous polyester resin 1) are put into a separable flask and a 3 wt % sodium sulfate aqueous solution is added dropwise until the volume average particle diameter thereof becomes 4.0μm. Subsequently, 100 parts by weight of stopped water are added and the reaction is stopped. Next, methyl ethyl ketone and isopropyl alcohol are desolvated while sending the air at 25° C., thereby obtaining a toner dispersion. The toner dispersion is suctioned and filtered and then a cake is obtained. Next, 300 parts by weight of taken-out water are added to the cake and the solution is stirred for 10 minutes in an environment of ultrasonic waves. The pH thereof is adjusted to be 3 using 1 N of hydrochloric acid, a 1 wt % polyethyleneimine (PEI, manufactured by JUNSEI CHEMICAL CO., LTD., weight average molecular weight: 70,000) aqueous solution is added to toner particles and stirred for 1 hour, and the mixture is washed with water and then freeze-dried for 40 hours, thereby obtaining 90 parts by weight of PEI-treated toner particles having a volume average particle diameter Dv50 of 4.0 Silicone oil (trade name: KF96-20CS, manufactured by Shin-Etsu Chemical Co., Ltd.) is added to 15 parts by weight of the PEI-treated toner particles as a carrier liquid and the total amount is adjusted to 50 parts by weight. Further, the mixture is stirred using ULTRA-TURRAX T50 at 8800 rpm for 1 minute, thereby obtaining a comparative liquid developer 1.

Comparative Example 2

Preparation of Comparative Toner Particles 2 and Comparative Liquid Developer 2

100 parts by weight of fine particles 5 (amorphous polyester resin 1 having an unsaturated double bond) are put into a separable flask and a 3 wt % sodium sulfate aqueous solution is added dropwise until the volume average particle diameter thereof becomes 4.0 μm. Subsequently, 100 parts by weight of stopped water are added and the reaction is stopped. Next, methyl ethyl ketone and isopropyl alcohol are desolvated while sending the air at 25° C., thereby obtaining a toner dispersion. The toner dispersion is suctioned and filtered and then a cake is obtained. Next, 300 parts by weight of taken-out water are added to the cake and the solution is stirred for 10 minutes in an environment of ultrasonic waves. The pH thereof is adjusted to be 3 using 1 N of hydrochloric acid, a 1 wt % polyethyleneimine (PEI, manufactured by JUNSEI CHEMICAL CO., LTD., weight average molecular weight: 70,000) aqueous solution is added to toner particles and stirred for hour, and the mixture is washed with water and then freeze-dried for 40 hours, thereby obtaining 90 parts by weight of PEI-treated toner particles having a volume average particle diameter Dv50 of 4.0 Silicone oil (trade name: KF96-20CS, manufactured by Shin-Etsu Chemical Co., Ltd.) is added to 15 parts by weight of the PEI-treated toner particles as a carrier liquid and the total amount is adjusted to 50 parts by weight. Further, the mixture is stirred using ULTRA-TURRAX T50 at 8800 rpm for 1 minute, thereby obtaining a comparative liquid developer 2.

Evaluations

Image Forming Method

An image is prepared by placing a liquid developer on a membrane filter (manufactured by Japan Millipore Corporation, OMNIPORE: 0.2 μm) such that TMA (toner mounting amount) becomes 4 ($g/m^2$) and transferring the liquid developer to a film for an overhead projector (VF1420N, manufactured by KOKUYO Co., Ltd.) using a pressure stretching machine (IMC-1102 type, manufactured by Imoto Machinery Co., Ltd.). The image is placed on a hot plate whose temperature is set to 130° C. An image of a photocurable film is prepared by applying light such that the irradiation light amount becomes 400 $mJ/cm^2$ and the distance from a light source becomes 10 cm using a high pressure mercury lamp (manufactured by USHIO INC.) in an atmosphere.

Amount of Compound Having Sulfanyl Group Eluted in Carrier Liquid

Centrifugation is performed on a liquid developer at 10,000 rpm for 30 minutes using a centrifugal separator, an operation of substituting the obtained supernatant with silicone oil (KF96-20 CS, manufactured by Shin-Etsu Chemical Co., Ltd.) is repeatedly performed 10 times, and a decreasing rate of an adsorption peak of a sulfanyl group at around of 2560 $cm^{-1}$ is calculated using samples of the supernatant before and after substitution with an infrared spectrophotometer (FT-IR4000, manufactured by JASCO Corporation). Evaluation is performed based on the following criteria. The results thereof are listed in Table 1.

+: The particles are only adhered to a negative electrode.
−: The particles are only adhered to a positive electrode.
±: The particles are adhered to both electrodes.
×: The particles are not adhered to either of electrodes.

TABLE 1

| | Composition of materials | | | | Evaluation | | |
|---|---|---|---|---|---|---|---|
| | Vinyl group of amorphous resin monomer (% by mole) | Vinyl group of crystalline resin monomer (% by mole) | m + n of compound (I) | Number of carbon atoms of $R^1$ and $R^2$ of compound (I) | Amount of compound having sulfanyl group | Photocuring properties (after performing substitution 10 times with carrier liquid) | Positive charging properties |
| Example 1 | 30 | 0 | 1,000 | 12 | A | B | + |
| Example 2 | 30 | 50 | 1,000 | 12 | A | A | + |
| Example 3 | 30 | 50 | 1,000 | 2 | A | A | + |
| Example 4 | 30 | 50 | 10,000 | 12 | A | A | + |
| Example 5 | 30 | 50 | 20 | 12 | A | A | + |
| Example 6 | 20 | 20 | 1,000 | 12 | A | B | + |
| Example 7 | Core: 50 (shell: 0) | Core: 50 | 1,000 | 12 | A | A | + |
| Comparative Example 1 | 0 | 0 | KARENZ MTPE1 | | B | D | ± |
| Comparative Example 2 | 30 | 0 | KARENZ MTPE1 | | B | C | ± |

A: The peak of a sulfanyl group is almost unchanged (decreasing rate: less than 10%).

B: The peak of a sulfanyl group is decreased (decreasing rate: 10% or greater).

Photocuring Properties

The photocuring properties are evaluated based on solvent resistance by forming an image according to the above-described image forming method using the above-described substituted liquid developer. That is, with a paper towel (KIMWIPE, manufactured by NIPPON PAPER CRECIA Co., Ltd.) unpregnated with 1 g of ethanol, the formed image is reciprocatively rubbed and the evaluation is visually performed based on the following criteria. The results are listed in Table 1.

A: The image is not destroyed at all.

B: The image is mostly not destroyed.

C: A part of the image is destroyed.

D: The nearly entire image is destroyed.

Charging Polarity

Two sheets of ITO glass substrates (100 Ω/square, manufactured by EHC Inc.) processed to have a dimension of 5 cm×1 cm are fixed such that the electrode surfaces become inward interposing a NAFLON sheet (1 cm×1 cm×1.0 mm, manufactured by AS ONE Corporation) as an insulating spacer. 1 mL of a liquid developer sample is put in a disposable cell (12 mm×12 mm×45 mm, manufactured by AS ONE Corporation), the above-described electrode substrates are immersed, 250 V of a DC voltage is applied thereto for 30 seconds, the electrodes are pulled up in a state in which the voltage is applied, the state of particles being adhered to the positive and negative ITO electrode surfaces is observed, and the charging characteristics are determined. The results thereof are listed in Table 1. In addition, when the charging characteristics below show positive and negative (±), this means that particles having positive polarity and particles having negative polarity are evenly mixed with each other, but fog occurs in a bright image portion in an actual system when using a developer exhibiting such characteristics. Therefore, such developer is not suitable for both of a positively charged system and a negatively charged system.

In this manner, in Examples, deterioration of photocuring properties is prevented compared to Comparative Examples. The reason therefor is considered that elution of the compound represented by the formula (I) in a carrier liquid is prevented compared to a thiol compound KARENZ MTPE1 and thus deterioration of photocuring properties is prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer containing:

a carrier liquid; and a toner particle which contains a resin having an unsaturated double bond, a compound represented by the formula (I) and a photopolymerization initiator, and whose surface is treated by a polyamine, (I)

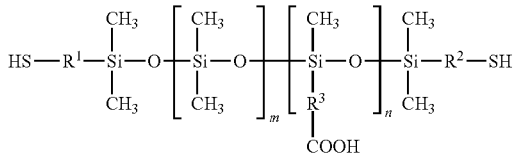

wherein m and n each independently represent an integer of 1 to 10,000; m+n represents an integer of 10 to 10,000; and $R^1$, $R^2$ and $R^3$ each independently represent a single bond or a divalent aliphatic hydrocarbon group having 1 to 12 carbon atoms.

2. The liquid developer according to claim 1, wherein the resin having an unsaturated double bond contains an amorphous resin and a crystalline resin, and 30% by mole or more of a monomer unit constituting the amorphous resin and 30% by mole or more of a monomer unit constituting the crystalline resin each contain an unsaturated double bond.

3. The liquid developer according to claim 1, wherein the amount of the compound represented by the formula (I) is in a range of from 0.1 parts by weight to 5 parts by weight with respect to 100 parts by weight of the toner particles.

4. The liquid developer according to claim 1, wherein the content of the polyamine is in a range of from 0.1 parts by weight to 10 parts by weight with respect to 100 parts by weight of the toner particles.

5. The liquid developer according to claim 1, wherein the content of the photopolymerization initiator is in a range of from 1% by weight to 10% by weight with respect to the amount of the entirety of the toner particles.

6. The liquid developer according to claim 1, wherein a weight average molecular weight of the polyamine is in a range of from 5,000 to 100,000.

7. The liquid developer according to claim 1, wherein the weight ratio of the amount of the compound represented by the formula (I) to the amount of the polyamine is in a range of from 1:20 to 10:1.

8. A developer cartridge that is detachable from an image forming apparatus, comprising:

a container which stores the liquid developer according to claim 1.

9. The developer cartridge according to claim 8, wherein the resin having an unsaturated double bond of the liquid developer contains an amorphous resin and a crystalline resin, and 30% by mole or more of a monomer unit constituting the amorphous resin and 30% by mole or more of a monomer unit constituting the crystalline resin each contain an unsaturated double bond.

10. The developer cartridge according to claim 8, wherein the amount of the compound represented by the formula (I) of the liquid developer is in a range of from 0.1 parts by weight to 5 parts by weight with respect to 100 parts by weight of the toner particles.

11. The developer cartridge according to claim 8, wherein the content of the polyamine of the liquid developer is in a range of from 0.1 parts by weight to 10 parts by weight with respect to 100 parts by weight of the toner particles.

12. The developer cartridge according to claim 8, wherein the content of the photopolymerization initiator of the liquid developer is in a range of from 1% by weight to 10% by weight with respect to the amount of the entirety of the toner particles.

13. An image forming apparatus comprising:

an image holding member;

a latent image forming unit that forms a latent image on the surface of the image holding member;

a developing unit that develops the latent image formed on the surface of the image holding member using the liquid developer according to claim 1 to form a toner image;

a transfer unit that transfers the toner image formed on the surface of the image holding member onto a recording medium;

a fixing unit that fixes the toner image transferred onto the recording medium to form a fixed image; and a curing unit that cures the fixed image.

14. The image forming apparatus according to claim 13, wherein the resin having an unsaturated double bond of the liquid developer contains an amorphous resin and a crystalline resin, and 30% by mole or more of a monomer unit constituting the amorphous resin and 30% by mole or more of a monomer unit constituting the crystalline resin each contain an unsaturated double bond.

15. The image forming apparatus according to claim 13, wherein the amount of the compound represented by the formula (I) of the liquid developer is in a range of from 0.1 parts by weight to 5 parts by weight with respect to 100 parts by weight of the toner particles.

16. The image forming apparatus according to claim 13, wherein the content of the polyamine of the liquid developer is in a range of from 0.1 parts by weight to 10 parts by weight with respect to 100 parts by weight of the toner particles.

* * * * *